US011246439B2

(12) United States Patent
Hardin

(10) Patent No.: US 11,246,439 B2
(45) Date of Patent: Feb. 15, 2022

(54) CLOTHING HANGER APPARATUS

(71) Applicant: Garrett T. Hardin, Newport, NC (US)

(72) Inventor: Garrett T. Hardin, Newport, NC (US)

( * ) Notice: Subject to any disclaimer, the term of this patent is extended or adjusted under 35 U.S.C. 154(b) by 86 days.

(21) Appl. No.: 16/745,259

(22) Filed: Jan. 16, 2020

(65) Prior Publication Data

US 2020/0221892 A1 Jul. 16, 2020

Related U.S. Application Data

(60) Provisional application No. 62/793,377, filed on Jan. 16, 2019.

(51) Int. Cl.
*A47G 25/20* (2006.01)

(52) U.S. Cl.
CPC ..... *A47G 25/20* (2013.01)

(58) Field of Classification Search
CPC ..... A47G 25/20
See application file for complete search history.

(56) References Cited

U.S. PATENT DOCUMENTS

| | | | | |
|---|---|---|---|---|
| 9,943,183 | B1 * | 4/2018 | Carter, Jr. | A47G 25/14 |
| 2020/0029715 | A1 * | 1/2020 | Dunshee | A47G 25/26 |
| 2020/0077825 | A1 * | 3/2020 | Curci | A47G 25/4023 |
| 2020/0221892 | A1 * | 7/2020 | Hardin | A47G 25/28 |

* cited by examiner

*Primary Examiner* — Clinton T Ostrup
*Assistant Examiner* — Andrew Wayne Sutton
(74) *Attorney, Agent, or Firm* — Jeffrey C. Watson; Grell & Watson Patent Attorneys LLC

(57) ABSTRACT

A clothing hanger apparatus may include a hanger frame member extending from a first end to a second end. The hanger frame member may include a hanger portion and a securing portion. The hanger portion may include a hook member configured to engage a hanger rod. The clothing hanger apparatus may include a hanger body that defines at least one aperture configured to operably engage the hanger frame member. The hanger body includes a first portion and a second portion, and the first portion may be disposed entirely on one side of a hook centerline defined by the hook member of the hanger frame member.

2 Claims, 4 Drawing Sheets

CLOTHING HANGER APPARATUS

CROSS-REFERENCE TO RELATED APPLICATION(S)

To the full extent permitted by law, the present U.S. Non-Provisional patent application hereby claims priority to and the full benefit of U.S. Provisional Patent Application No. 62/793,377, filed Jan. 16, 2019, the disclosure of which is each incorporated herein by reference in its entirety.

FIELD OF THE INVENTION

The present disclosure generally relates to a clothing hanger apparatus, and more specifically, to a clothing hanger apparatus for hooded apparel, such as, for example, hooded sweatshirts, hooded jackets, hoodies, and/or the like. The clothing hanger apparatus may be configured to provide for engaging a hooded portion of a garment, such as, for example, hooded sweatshirts, hooded jackets, hoodies, and/or the like.

BACKGROUND

Generally speaking, garments and apparel, such as, for example, hooded sweatshirts, hooded jackets, hoodies, and/or the like, are stored and displayed on typical clothing hangers that require the garment to be hung by the shoulder and/or sleeve areas of the garment. In particular, a typical clothing hanger includes arm portions that usually extend an equal length from a hook hanger along a single plane. These arm portions engage the shoulder and/or sleeve portions of the garment. Additionally, the typical clothing hanger requires both shoulder and/or sleeve portions of the garment to engage the arm portions of the clothing hanger to prevent the garment from falling off the clothing hanger. Attempting to store a clothing item on one of the two arm portions of a traditional clothing hanger may result in, at best, the clothing item falling off the hanger. Other results may include wrinkling, stretching, and/or damaging the clothing item.

Therefore, a need exists for a clothing hanger device that provides for securely and easily storing a garment or clothing item, such as, for example, hooded sweatshirts, hooded jackets, hoodies, and/or the like, by a hooded portion of the clothing item without wrinkling, stretching, and/or damaging the clothing item.

BRIEF SUMMARY

Example implementations of the present disclosure are directed to a clothing hanger apparatus that includes a hanger frame member and a hanger body. The hanger frame member may extend from a first end to a second end. Additionally or alternatively, the hanger frame member may include a hanger portion, which may include a hook member configured to operably engage a rod, such as, for example, a clothing hanger rod.

According to some apsects of the present disclosure, the clothing hanger apparatus may include a hanger body defining at least one aperture configured to operably engage the hanger frame member. The hanger body may include a first portion and a second portion, and the first portion of the hanger body may be disposed entirely on one side of a hook centerline defined by the hook member of the hanger frame member. That is, the hook centerline defined by the hook member of the hanger frame member does not intersect any part of the first portion of the hanger body.

According to some aspects, the hanger body further may include an apparel engaging portion. The apparel engaging portion may be disposed between the first portion and the second portion of the hanger body. Additionally or alternatively, the apparel engaging portion may include a flanged surface disposed between the first portion and the second portion of the hanger body.

According to one aspect of the present disclosure, the first portion of the hanger body may define a curved upper surface. Additionally or alternatively, the second portion of the hanger body may define an aperture that is operably engaged with the hanger frame member. In some apsects, the clothing hanger apparatus may include a hanger body that includes a material configured to operably engage a clothing garment in a frictional engagement. According to some aspects, the hanger body may include a bottom surface that defines a securing channel. The securing channel may be configured to operably engage the securing portion of the hanger frame member.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

The present clothing hanger apparatus will be better understood by reading the Detailed Description with reference to the accompanying drawings, which are not necessarily drawn to scale, and in which like reference numerals denote similar structure and refer to like elements throughout, and in which.

Figure 1:
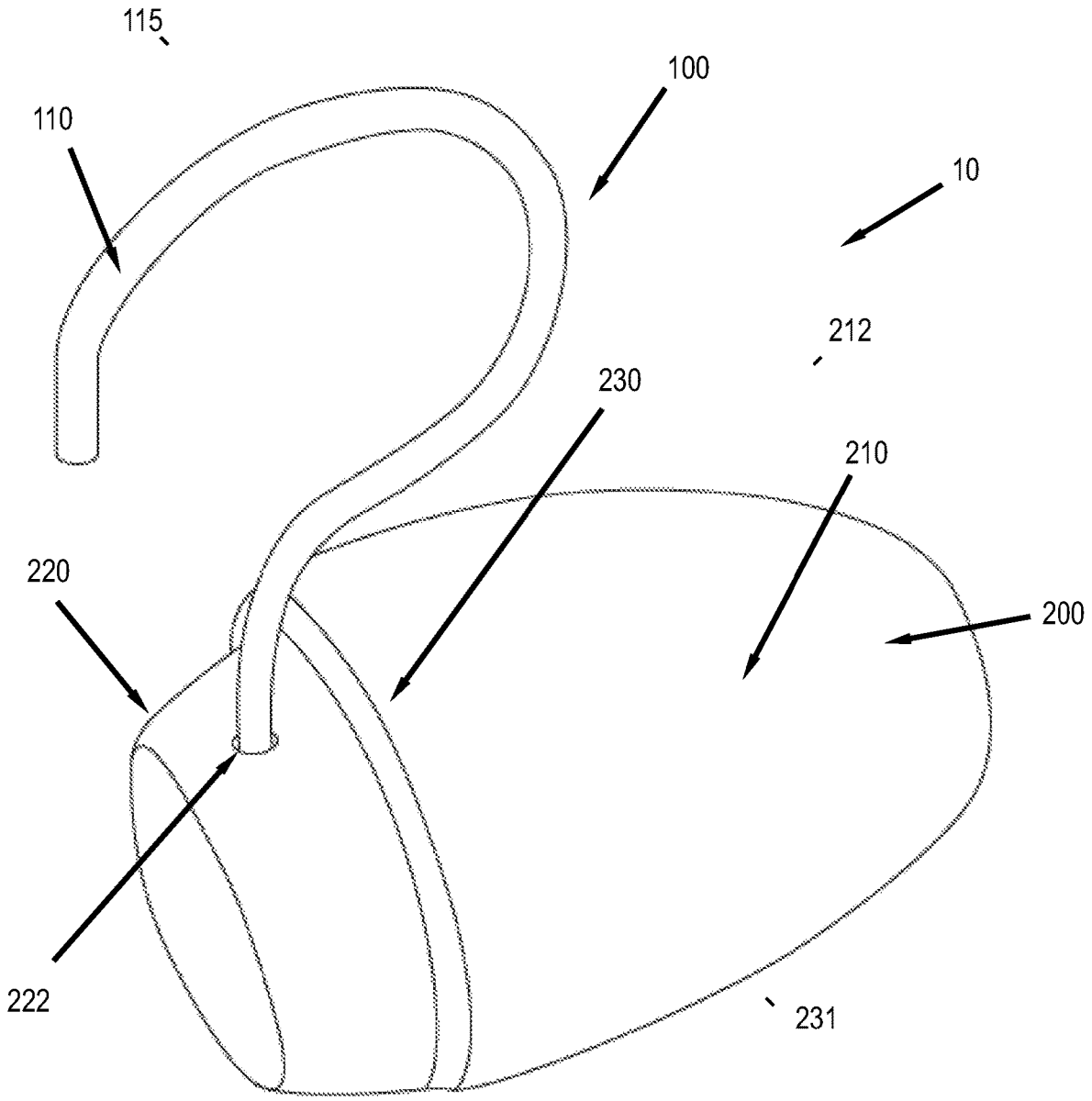
FIG. 1 illustrates a top perspective view of a clothing hanger apparatus according to one example aspect of the present disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Some implementations of the present disclosure will now be described more fully hereinafter with reference to the accompanying drawings, in which some, but not all implementations of the disclosure are shown. Indeed, various implementations of the disclosure may be expressed in many different forms and should not be construed as limited to the implementations set forth herein; rather, these exemplary implementations are provided so that this disclosure will be thorough and complete, and will fully convey the scope of the disclosure to those skilled in the art. As used herein, the term "and/or" and the "/" symbol includes any and all combinations of one or more of the associated listed items. Further, unless otherwise indicated, something being described as being a first, second or the like should not be construed to imply a particular order. It should be understood that the terms first, second, etc. may be used herein to describe various steps, calculations, positions and/or the like, these steps, calculations or positions should not be limited to these terms. These terms are only used to distinguish one operation, calculation, or position from another. For example, a first position may be termed a second position, and, similarly, a second step may be termed a first step, without departing from the scope of this disclosure. Additionally, something may be described as being above something else (unless otherwise indicated) may instead be below, and vice versa; and similarly, something described as being to the left of something else may instead be to the right, and vice versa. As used in the specification, and in the appended claims, the singular forms "a", "an", "the", include plural referents unless the context clearly dictates otherwise. Like reference numerals refer to like elements throughout.

Implementations of the present disclosure provide for a clothing hanger apparatus configured to operably engage a clothing item, garment, or apparel, such as, for example, a hooded sweatshirt, hooded jacket, hoodie, and/or the like. As shown in FIGS. 1-4, the clothing hanger apparatus 10 may include a hanger frame member 100 and a hanger body 200. As shown in FIGS. 1 and 3, the hanger frame member 100 may extend from a first end to an opposing second end. Additionally or alternatively, the hanger frame member may include a hanger portion 110 and a securing portion 120. According to some aspects, the hanger portion 110 may be disposed proximate the first end of the hanger frame member 100. In addition, the securing portion 120 may be disposed proximate the second end of the hammer frame number 100. The hanger portion 110 of the hanger frame member 100 may further include a hook member 115 configured to operably engage a hanger rod.

One aspect of the present disclosure provides for a clothing hanger apparatus that includes a hanger body 200 that defines at least one aperture configured to operably engage the hanger frame member 100. As shown in FIG. 1, the hanger body 200 may define an aperture 222 configured to operably engage the hanger frame member 100. According to some aspects, a hanger frame member 100 may initially be shaped such that a linear rod portion may be disposed proximate the end of the hanger portion 110 of the hanger frame member 200. The straight linear rod portion may then be inserted through the aperture 222 defined by the hanger body 200 such that the hook member 115 and/or the hanger portion 110 of the hanger frame member 100 extends a suitable length from the hanger body 200. Once the hook member 115 is placed at a desired length from the hanger body 200, a securing portion 120 of the hanger frame member 100 may engage the hanger body 200 such that the hanger frame member 100 is securely engaged with the hanger body 200.

Figure 2:
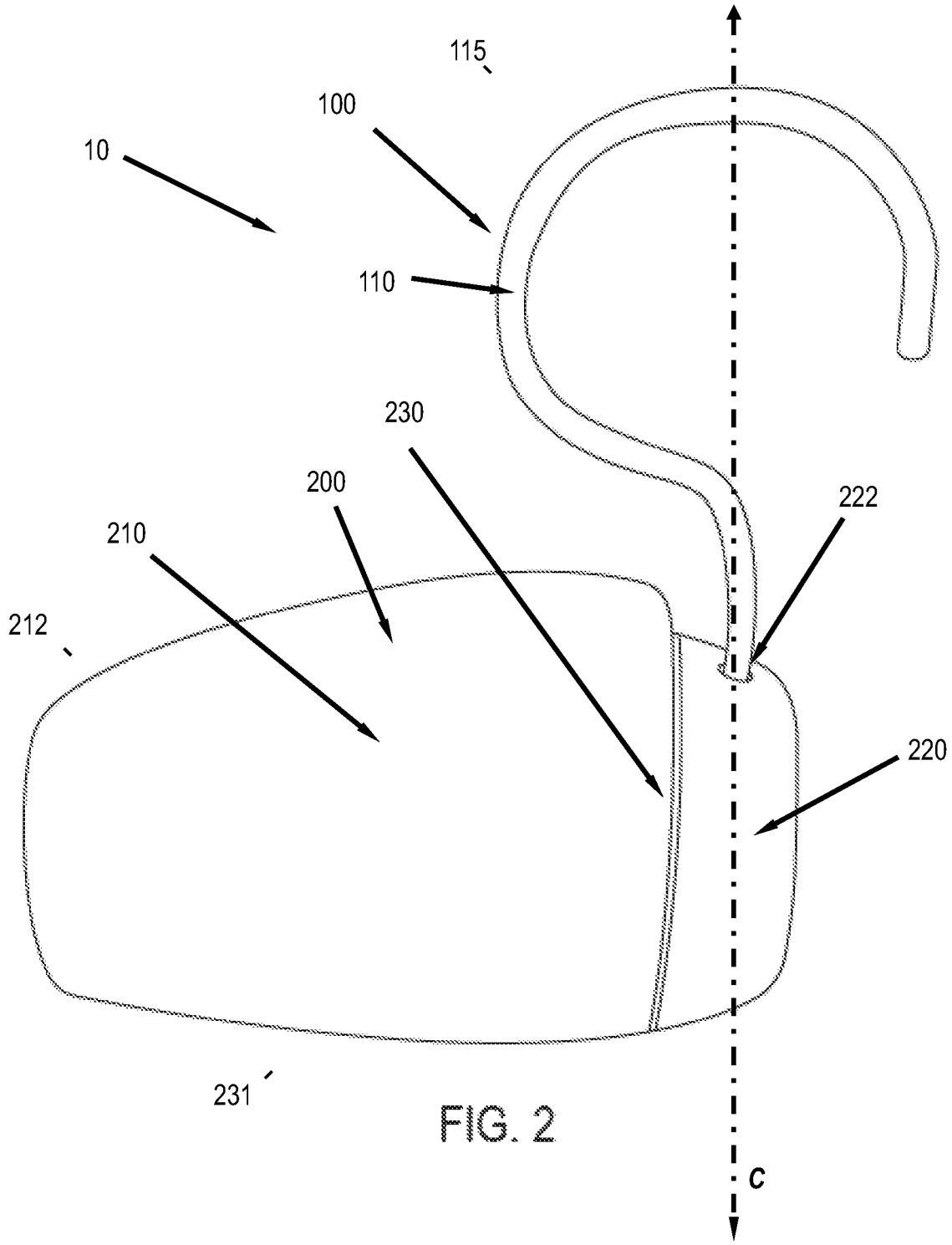
FIG. 2 illustrates a side view of a clothing hanger apparatus according to one example aspect of the present disclosure.
Figure 3:
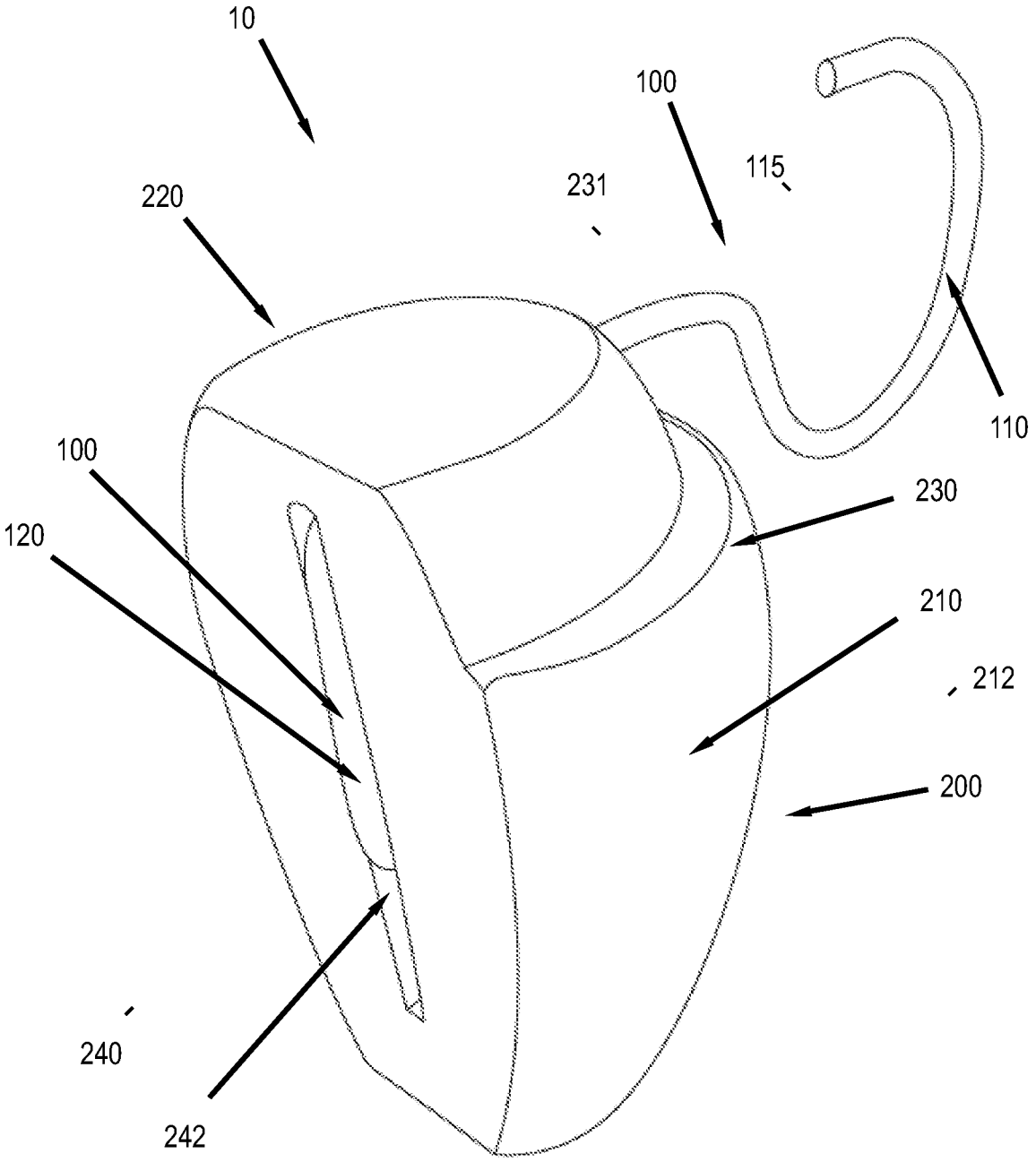
FIG. 3 illustrates a bottom perspective view of a clothing hanger apparatus according to one example aspect of the present disclosure.

According to some aspects of the present disclosure, as shown in FIGS. 1-3, a hanger body 200 of a clothing hanger apparatus 10 may include a first portion 210 and a second portion 220. In particular, as shown in FIG. 2, a first portion 210 of the hanger body 200 may be disposed entirely on one side of a hook centerline C. For example, the hook centerline C may be defined by the hook member 115 of the hanger frame member 100. In some aspects, the hook centerline C does not intersect, collide, or otherwise touch the first portion 210 of the hanger body 200. The hook centerline C may further coincide with the centerpoint of the aperture 222 of the hanger body 200.

According to another aspect of the present disclosure, the clothing hanger apparatus 10 may include a hanger body 200 that further includes an apparel engaging portion 230. The apparel engaging portion 230 may be disposed between the first portion 210 and the second portion 220 of the hanger body 200. Additionally or alternatively, the apparel engaging portion 230 may include a flanged surface 231. The flanged surface 231 may be disposed between the first portion 210 and the second portion 220 of the hanger body 200. According to some aspects, the flanged surface 231 of the apparel engaging portion 230 may bridge the first portion 210 and the second portion 220 of the hanger body 200. For example, the flanged surface 231 may bridge the first portion 210, which has a greater cross-sectional area than the second portion 220, with the second portion 210 having the smaller cross-sectional area.

Additionally, the hanger body 200 may include a first portion 210 that defines a curved upper surface 212. The curved upper surface 212 may include a semi-spherical, parabolic, and/or otherwise curved surface. According to some aspects, the curvature of the curved upper surface 212 may be sized proportionately to and/or directly to the crown of an individual's head. According to some aspects, the curved upper surface 212 may include a variety of shapes and sizes to accommodate differing sized hooded garments. For example, one aspect of the present disclosure may include a clothing hanger apparatus having a larger curved upper surface 212 for adult-sized clothing, while another clothing hanger apparatus may have a smaller curved upper surface 212 for children, youth, and/or infant clothing.

Figure 4:
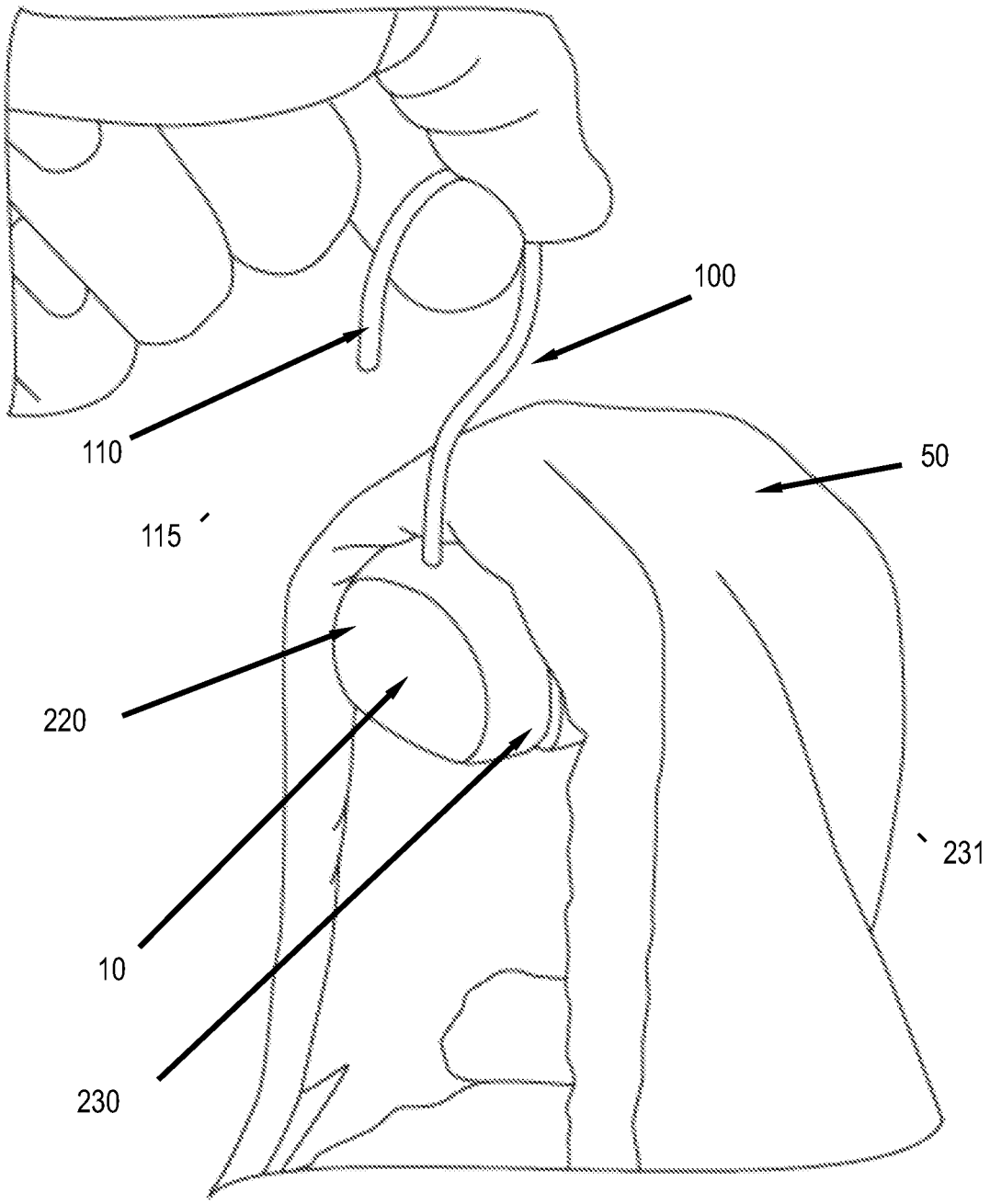
FIG. 4 illustrates a perspective view of a clothing hanger apparatus operably engaging a clothing item according to one example aspect of the present disclosure.

Another aspect of the present disclosure provides for a clothing hanger apparatus 10 configured to operably engage a hooded portion of a garment, as shown in FIG. 4. In some aspects, the clothing hanger apparatus 10 may include a material configured to operably engage a clothing garment in a frictional engagement. For example, the curved upper surface 212 of the hanger body 200 may include a substrate, coating, and/or the like configured to increase the frictional coefficient between the garment and the hanger body 200. In some aspects, the frictional material may be integrally formed with the hanger body. According to another aspect, the curved upper surface of the second portion of the hanger body may include a textured surface configured to increase the frictional coefficient between the garment and the hanger body 200. Other aspects of the present disclosure may provide for the material configured to operably engage the clothing garment in a frictional engagement to be disposed proximate other portions of the clothing hanger apparatus 10, such as, for example, the second portion 220 of the hanger body 200 and/or the flanged surface 231 of the apparel engaging portion 230 of the hanger body 200.

According to another aspect of the present disclosure, the hanger body 200 may be disproportionately weighted. For example, the hanger body 200 may include a first portion 210 and a second portion 220 that include different materials. In one aspect, the second portion 220 of the hanger body 200 may have a greater mass than the first portion 210 of the hanger body 200 such that the center of mass of the hanger body 200 may be displaced from a longitudinal midpoint of the hanger body 200. For example, the center of mass of the hanger body 200 may be disposed along the centerline C of the hanger frame member 100 such that placing a clothing item on the curved upper surface 212 of the first portion 210 of the hanger body 200 would not displace a clothing hanger apparatus 10 operably engaged with a clothing rod.

According to another aspect of the present disclosure, the hanger body 200 may include a bottom surface 240 that defines a securing channel 242, as shown in FIG. 3. The securing channel 242 may be configured to operably engage at least a portion of the hanger frame member 100. For example, the securing channel 242 may be configured to operably engage a securing portion 120 of the hanger frame member 100. In some aspects, the securing channel 242 may be sized to receive the securing portion 120 of the hanger frame member 100 in a friction fit. According to another aspect, the securing channel 242 may include a securing element to retain the securing portion 120 of the hanger frame member 100 within the securing channel 242.

The foregoing description comprises illustrative embodiments. Having thus described example embodiments, it should be noted by those skilled in the art that the within disclosures are example only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. A clothing hanger apparatus comprising:

a hanger frame member extending from a first end to a second end, wherein the hanger frame member includes a hanger portion and a securing portion, wherein the hanger portion includes a hook member configured to engage a hanger rod; and a hanger body including:

a first portion with a curved upper surface configured and sized to accommodate differing sizes of a hooded garment;

a second portion including at least one aperture configured to operably engage the hanger frame member;

the first portion having a greater cross-sectional area than the second portion of the hanger body;

an apparel engaging portion disposed between the first portion and the second portion, the apparel engaging portion including a flanged surface bridging the first portion with the greater cross-sectional area with the second portion with the smaller cross-sectional area, wherein the flanged surface is configured to engage the hooded garment; and a bottom surface including an elongated securing channel centered on the bottom surface configured to operably engage the securing portion of the hanger frame member.

2. The clothing hanger apparatus of claim 1, wherein at least a portion of the hanger body includes a material configured to operably engage a clothing garment in a frictional engagement.

* * * * *